United States Patent [19]

Olofsson et al.

[11] Patent Number: 4,850,276

[45] Date of Patent: Jul. 25, 1989

[54] MECHANISM FOR PRACTICE MINES

[75] Inventors: Göran Olofsson, Eskilstuna; Tord Andersson, Söraker, both of Sweden

[73] Assignee: Affärsverket FFV, Eskilstuna, Sweden

[21] Appl. No.: 145,779

[22] PCT Filed: May 25, 1987

[86] PCT No.: PCT/SE87/00259

§ 371 Date: Jan. 29, 1988

§ 102(e) Date: Jan. 29, 1988

[87] PCT Pub. No.: WO87/07710

PCT Pub. Date: Dec. 17, 1987

[30] Foreign Application Priority Data

Jun. 2, 1986 [SE] Sweden ..... 8602480

[51] Int. Cl.[4] ..... F42B 23/22

[52] U.S. Cl. ..... 102/401; 102/429

[58] Field of Search ..... 102/401, 424, 428, 429

[56] References Cited

FOREIGN PATENT DOCUMENTS 3424698 1/1986 Fed. Rep. of Germany ..... 102/424

864354 4/1941 France ..... 102/428

*Primary Examiner*—Deborah L. Kyle

*Assistant Examiner*—Richard W. Wendtland

*Attorney, Agent, or Firm*—Fleit, Jacobson, Cohn, Price, Holman & Stern

[57] ABSTRACT

A mechanism assembly for a practice mine, comprising a mine body (1) being mounted thereon a housing (3) which incorporates an axially movable and axially rotatable arming plunger (4) which can be manually depressed from outside the mine in a manner to produce an arming movement which simulates a desired arming function of the mine. The mechanism assembly incorporates a release plunger (13) which can be depressed manually from outside the mine and which is arranged for operative co-action via a catch plate (7) and a locking device (16) with the arming plunger in a manner to influence the arming movement of the arming plunger.

6 Claims, 2 Drawing Sheets

MECHANISM FOR PRACTICE MINES

TECHNICAL FIELD

The present invention relates to a mechanism assembly intended for practice mines of the kind which are intended to simulate a live mine and which comprise a mine body, the mechanism assembly comprising a mechanism housing mounted on the mine body and incorporating an axially movable and axially rotatable arming plunger which can be depressed manually from outside the mine, to obtain therewith an arming movement which simulates a desired arming function of the mine, and which further incorporates an axially movable release piston which can be depressed from outside of the mine and which is arranged to co-act operatively with the arming plunger in the depressed position thereof, in a manner to influence the arming movement of the plunger.

PRIOR ART

With practice or training mines of this kind the torque prevailing at the terminal positions of the axially rotatable arming plunger is taken up by a cylindrical locking pin that passes through a hole extending radially through the arming plunger. It has been found, however, that repeated arming and disarming of the mechanism is liable to result in wear on the hole, such that the pin will not be held firmly therein, due to the resultant clearance between the pin and the hole-defining surfaces, with the accompanying risk that the pin may loosen and fall away.

Another drawback with known practice mines of this kind is that the provision of the grooves required in the mechanism housing to accommodate and guide the terminal positions of the pin is both difficult and extensive.

DISCLOSURE OF THE INVENTION

The object of the invention is therefore to provide a mechanism of the aforesaid kind which will function more reliably than the known mechanism, even after being repeatedly armed and disarmed, and which can be manufactured more readily than the aforesaid known mechanism. This object is achieved with a mechanism of the aforesaid kind that has the characterizing features set forth in claim 1.

Further features of the invention are set forth in the depending claims.

BRIEF DESCRIPTION OF THE DRAWINGS

The invention will now be described in more detail with reference to the accompanying drawings, which illustrate a preferred embodiment of the inventive mechanism assembly.

DESCRIPTION OF A PREFERRED EMBODIMENT

Figure 1:
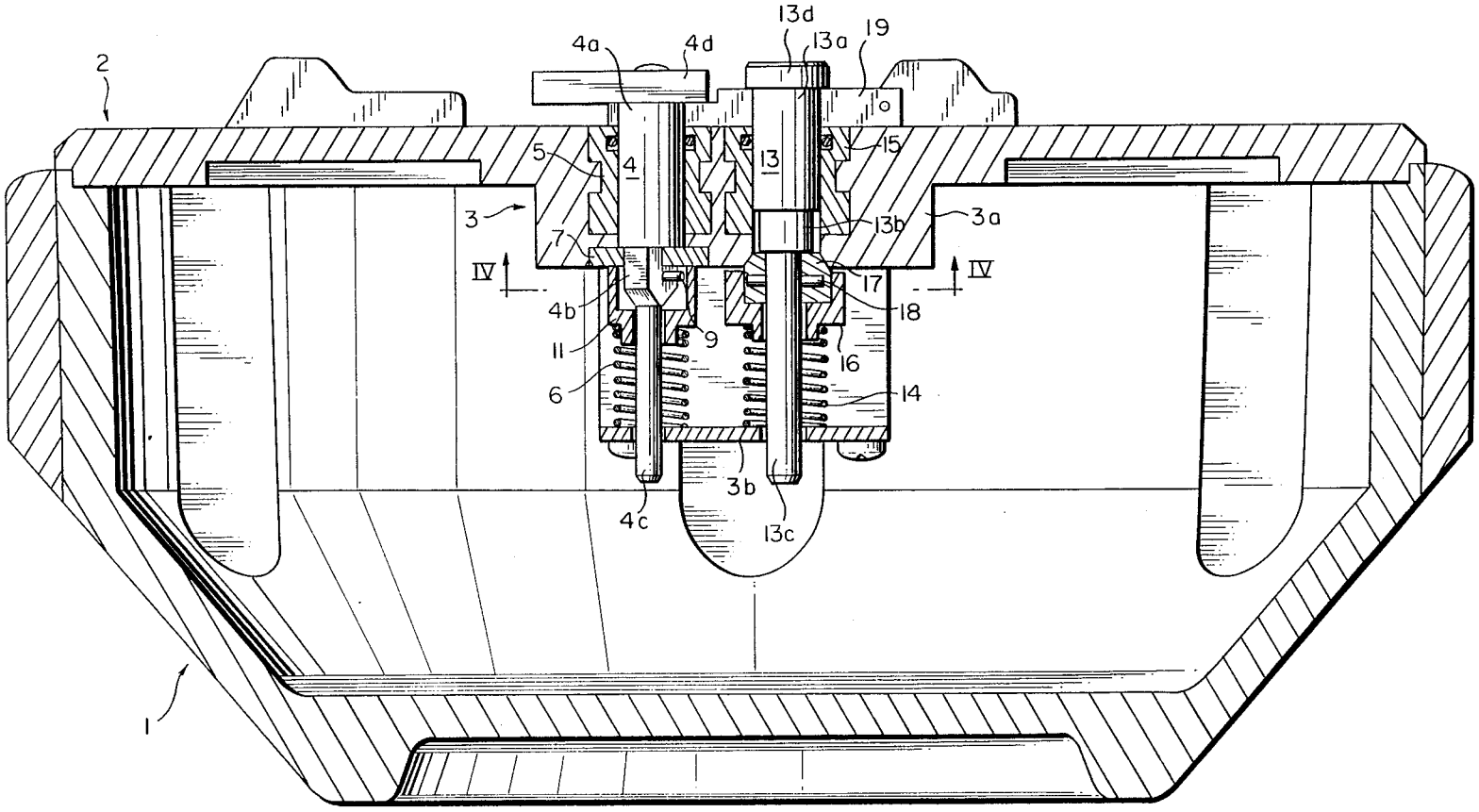
FIG. 1 is a cross-sectional view of a practice mine fitted with the inventive mechanism assembly.

FIG. 1 illustrates a substantially hemi-spherical, empty metallic mine body 1 of the kind which is conventionally found with anti-tank mines and which, in accordance with the invention, forms the mine body of a practice mine which is intended preferably to be laid in a horizontal position. The outwardly facing circular orifice of the mine body is covered with a conventional metal cover member 2, the centrally located part of which, however, is modified in accordance with the invention to form a housing 3 which accommodates the inventive mechanism. An axially rotatable metallic arming plunger 4 is mounted for axial movement in a bush 5 located in an outer wall 3*a* of the housing 3, and can be depressed into the housing against the action of a first thrust or compression spring 6.

Figure 2:
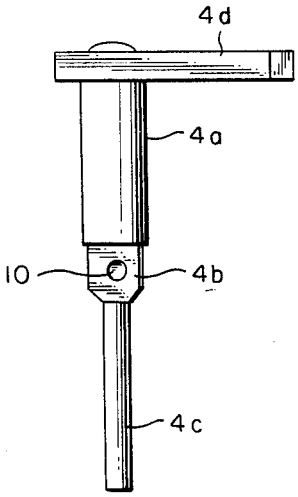
FIG. 2 is a side view of an arming plunger incorporated in the mechanism assembly illustrated in FIG. 1.

As will be seen more clearly from FIG. 2, the arming plunger 4 consists of an elongated member having a first, cylindrical end-part 4*a*, which is mounted for axial movement in the bush 5, and intermediate part 4*b*, which has a rectangular shape in cross-section and which tapers at one end thereof remote from said first end-part 4*a* into a cylindrical second end-part 4*c* of smaller diameter of the first mentioned end-part 4*a*.

Figure 3:
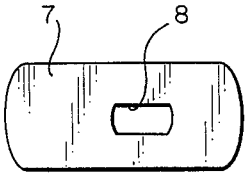
FIG. 3 is a plan view of a catch plate incorporated in the mechanism illustrated in FIG. 1.

A metal catch plate 7 (c.f. also FIG. 3) is non-rotatably connected with the intermediate part 4*b* of the plunger 4 and extends transversely in relation thereto. In the case of the illustrated embodiment (c.f. in particular FIGS. 1 and 3) the non-rotatable connection is achieved through the combination of a non-round aperture provided in the catch plate 7, in the illustrated embodiment an essentially elongated rectangular aperture 8, and an intermediate plunger-part 4*b* which is of corresponding non-round shape and passes freely through said aperture. The catch plate 7 is held axially in place on the intermediate part 4*b* of the plunger 4 through the abutment of its one, upper side with the bottom surface of the end-part 4*a*, which therewith forms a supporting shoulder, and through the supporting action of a locking pin 9 which is passed through a hole 10 located in the intermediate part, on the under side of the catch plate.

Figure 4:
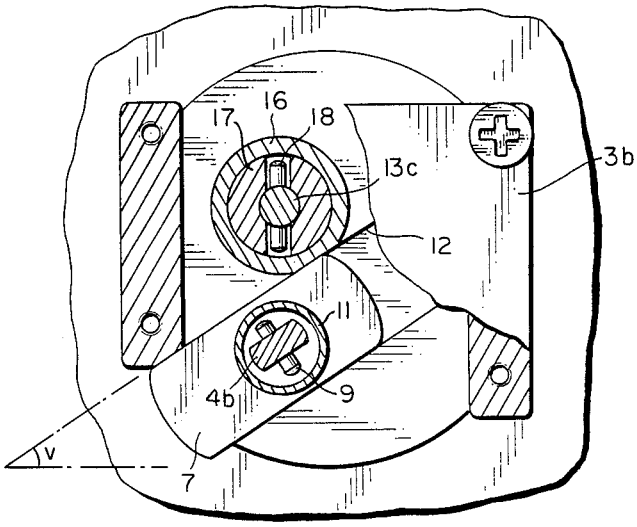
FIG. 4 is a cross-sectional view taken on the line IV—IV in FIG. 1 and turned through 45°, and illustrates the arming plunger in a disarming or safe position.

The second end-part 4*c* of the arming plunger 4 is displaceable axially through a hole located in an inner wall 3*b* of the housing 3. The spring 6 therewith encircles the second end-part 4*c* of the plunger, with the lower end of the spring supported against the radially inner wall 3*b* of the housing. The upper end of the spring 6 bears forcibly against one end of a bearing sleeve 11 which fits over the second end-part 4*c* of the plunger and is movable axially therealong. The other end of the sleeve abuts the undersurface of the catch plate 7. The uppersurface of the catch plate 7 is engaged in a horizontally positioned catch plate groove or channel 12 (c.f. FIG. 4) provided in the inwardly facing surface of the radially outer wall 3a of the housing 3 (FIG. 1), the spring 6 thus striving to hold the catch plate 7 firmly in the groove 12.

As illustrated, the groove 12 is inclined at an angle v of about 45° towards a metallic release plunger 13, for reasons hereinafter made apparent. The release plunger 13 extends parallel with the arming plunger 4 and is mounted for axial movement in the outer wall 3*a* of the housing 3, depression of the release plunger into the housing being effected against the action of a second thrust or compression spring 14.

Similar to the arming plunger 4, the release plunger 13 consists of an elongated member having a first cylindrical upper end-part 13*a*, which is mounted for axial movement in a bush 15 provided in the outer wall 3*a* of the housing 3, a cylindrical intermediate part 13*b* of smaller diameter than the end-part 13*a*, and a second cylindrical end-part 13*c*, a lower end-part, whose diameter is smaller than the diameter of the intermediate part 13*b*.

The second end-part 13*c* of the release plunger 13 is mounted for axial movement in a hole provided in the inner wall 3*b* of the housing 3. The spring 14 thus encircles the second end-part 13*c* of said release plunger and is held with the lower end of the spring in abutment with the inner wall 3*b* of the housing and with the upper end of the spring bearing forcibly against the adjacent end of a first latching device, in the form of a locking sleeve 16 which is fitted over the second end-part 13*c* and is axially movable therealong.

The locking sleeve 16 accommodates a second latching device, in the form of a latching sleeve 17 having a conically bevelled upper end which abuts the outer wall 3*a* of the housing 3. The latching sleeve 17 is held in position on the end-part 13*c* of the release plunger, by means of a locking pin 18 which is inserted through respective holes located in the end-part 13*c* and the latching sleeve 17, so as to extend transversely to the longitudinal centres thereof.

Unintentional or accidental depression of the arming plunger 4 and the release plunger 13 is prevented by a rod-shaped safety device 19 which when it its safe, transportation position lies between the upper surface of the outer wall 3*a* of the housing 3 and the under surface of an arming device 4*d*, such as an arming lever, located on the arming plunger 4, and the under surface of a circular head 13*d* on the release plunger 13. The arming device 4*d* and the release head 13*d* thus constitute actuating means by means of which the mine can be activated manually from outside the mine, so as to obtain the desired simulated arming function. The mechanism operates in the following manner.

Figure 5:
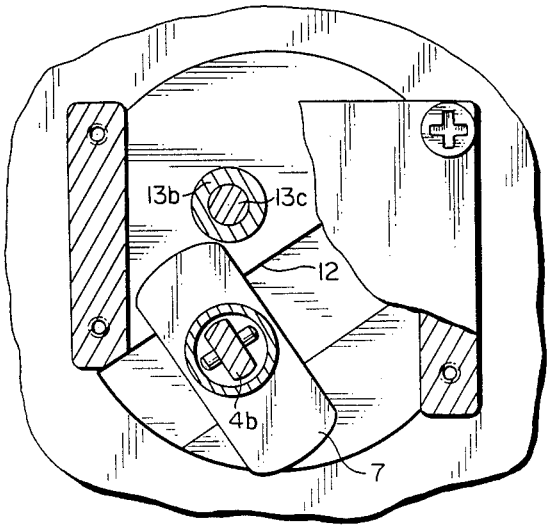
FIG. 5 is a cross-sectional view similar to that of FIG. 4 but with the arming plunger shown in its arming position.

When the arming plunger 4 is depressed, by activating the arming lever 4*d*, the catch plate 7 is automatically moved out of the catch-plate groove 12 located in the wall 3*a* of the housing 3. It is still not possible, however, to turn the lever 4*d*, due to the fact that in this position the catch plate is still in abutment with an edge part of the locking sleeve 16 on the release plunger 13, as a result of the inclination of the groove 12. This latching action is clearly shown in FIG. 4. However, by depressing the release head 13*d*, and therewith also the release piston 13, the release plunger is moved axially downwards so that the catch plate becomes free from the locking sleeve 16 and so that the bevelled surface on the latching sleeve 17 is located centrally opposite the catch plate 7 instead. The arming lever 4*d* can now be turned until the catch plate 7 has been rotated through about 90°-95°, wherewith the catch plate is brought into contact with the bevelled part of the latching sleeve 17. When the pressure on the release head 13*d* is removed, the spring 14 effects a wedging action which holds the catch plate 7 firmly against the bevelled part of the latching sleeve 17, as illustrated in FIG. 5. The mine is now in its simulated armed state.

The catch plate arrangement and the co-action of the catch plate 7 with the release plunger 13 provides a particularly reliable mechanism which can be armed and disarmed repeatedly a great many times without malfunctioning.

In the illustrated embodiment the inventive mechanism forms part of a conventional lid or cover member of a mine body. Although not shown, the mechanism assembly may alternatively form a separate unit which is mounted on the mine body or on the cover member thereof.

We claim:

1. A mechanism assembly for a practice mine of the kind which is intended to simulate a live mine, comprising:

a mine body having mounted thereon a housing which incorporates an axially movable and axially rotatable arming plunger which can be depressed manually from outside the mine in order to obtain an arming movement which simulates a desired arming function of the mine, an axially movable release plunger which can be depressed manually from outside the mine and which is arranged to co-act operatively with the arming plunger in its depressed position in a manner to influence the arming movement of said plunger, a catch plate which is connected to the arming plunger by a non-rotatable connection, said non-rotatable connection being obtained through the combination of a non-round aperture provided in the catch plate and an intermediate plunger-part having a corresponding non-round cross-sectional shape and extending freely through said aperture, the catch plate being held on said intermediate part of the arming plunger by means of a locking pin inserted therethrough and being held firmly in latching position in said housing by means of a spring such as to prevent rotation of the arming plunger to a simulated armed position, and which against the action of said spring can be brought out of said latching position as a result of said depression of the arming plunger; the release plunger presenting a locking device which when the release plunger is in its non-depressed position is located in operative co-action with the catch plate in the depressed position of the arming plunger, so as to prevent axial rotation of said plunger, but which in the depressed position of the release plunger has relinquished said operative coaction with the catch plate, therewith to permit the catch plate to rotate to the simulated armed position.

2. A mechanism assembly according to claim 1, wherein the locking device is held in said operative co-action by means of a second spring.

3. A mechanism assembly according to claim 1, and further comprising:

an arming device located on said arming plunger, a circular head located on said release plunger, and a transportation safety device preventing depression of the arming and release plungers when in a position between an upper surface of said housing and an under surface of said arming device and said circular head.

4. A mechanism assembly according to claim 2, wherein the release plunger presents a second latching device which holds the catch plate in the armed position under the action of the second spring.

5. A mechanism assembly according to claim 4, wherein the second latching device consists of a conical part on a cylindrical sleeve (13) extending over the release plunger (13).

6. A mechanism assembly according to claim 5, wherein the sleeve is gripped firmly by the second spring on the release plunger with the aid of a locking pin extending through said release plunger.

* * * * *